US007027005B1

(12) United States Patent
Chien

(10) Patent No.: US 7,027,005 B1
(45) Date of Patent: Apr. 11, 2006

(54) BROADBAND DIPOLE ARRAY ANTENNA

(75) Inventor: Chun-Chien Chien, Taoyuan (TW)

(73) Assignee: SmartAnt Telecom Co., Ltd., Hsinchu (CN)

( * ) Notice: Subject to any disclaimer, the term of this patent is extended or adjusted under 35 U.S.C. 154(b) by 16 days.

(21) Appl. No.: 10/948,448

(22) Filed: Sep. 23, 2004

(51) Int. Cl.
*H01Q 9/28* (2006.01)

(52) U.S. Cl. ..... 343/795; 343/873; 343/893

(58) Field of Classification Search ..... 343/700 MS, 343/795, 873, 878, 879, 893
See application file for complete search history.

(56) References Cited

U.S. PATENT DOCUMENTS

| | | | | |
|---|---|---|---|---|
| 4,758,843 | A * | 7/1988 | Agrawal et al. | 343/814 |
| 5,285,212 | A * | 2/1994 | McNiece | 343/795 |
| 6,127,981 | A * | 10/2000 | Pritchett et al. | 343/711 |
| 6,417,816 | B1 * | 7/2002 | Sadler et al. | 343/795 |
| 6,529,171 | B1 * | 3/2003 | Le Balier et al. | 343/795 |
| 6,906,678 | B1 * | 6/2005 | Chen | 343/795 |

* cited by examiner

*Primary Examiner*—Shih-Chao Chen
(74) *Attorney, Agent, or Firm*—Welsh & Katz, Ltd.

(57) ABSTRACT

A broadband dipole array antenna adopted for use in radio transmission includes a feed network, radiation units and a reflection plate. The antenna is held vertically in a trough of the reflection plate, which reflects the radiation signals of the antenna to enhance antenna directionality. The antenna and the reflection plate are fastened with adhesive tape or a Velcro strip in the trough to facilitate assembly of the antenna.

13 Claims, 11 Drawing Sheets

BROADBAND DIPOLE ARRAY ANTENNA

FIELD OF THE INVENTION

The invention relates to a broadband dipole array antenna adopted for use on electronic devices to perform radio transmission, and particularly a broadband dipole array antenna that is equipped with a reflection plate with a trough formed thereon.

BACKGROUND OF THE INVENTION

With continuous advances in the wireless communication industry, users can transmit information through radio transmission systems without geographical restrictions. The antenna is an important element in such radio transmission systems. Commonly used antennas include dipole antennas, helical antennas, and the like.

While radio transmission is relatively free from geographical restriction, when the antenna is installed on a location with geographical obstacles (such as corners of walls, ceiling, etc.), its directional gain drops, and the communication quality of signal transmission and reception suffers. To remedy this problem, a common approach is to install a reflection plate on one side of the antenna to enhance the directionality of the antenna, boost the directional gain and improve communication quality.

R.O. C. patent No. 558080 entitled "Dipole antenna equipped with a reflection plate" discloses a reflective dipole antenna. It has a dipole antenna and a reflection plate. The reflection plate has an opening and is spaced from one side of the dipole antenna at a selected distance. The shortest distance between the dipole antenna and the reflection plate is 1/4λ (λ is the wavelength of the frequency spectrum). The reflection plate reflects radiation signals to improve the directional gain of radiation reception and transmission of the dipole antenna.

While the reflection plate can reflect the radiation signals to improve directional gain, it still is not adequate when high directionality is required. Moreover, the reflection plate has to be spaced from the antenna at a selected distance (¼λ), causing difficulty in assembly. Hence how to improve the directionality of the antenna and facilitate convenience of assembly have become issues to be resolved.

Refer to FIG. 1 for a conventional antenna 10 that adopts a series feed network design. Such a design is applicable only in a selected and narrow frequency spectrum (such as 4.9~5.0 GHz, U-NII-One/Two 5.15~5.35 GHz, U-NII-Three 5.725~5.875 GHz). It cannot be used with radio communication that covers multiple frequency spectrums (such as 4.9~5.875 GHz). In such a situation, two or more antennas have to be used. Hence to increase the antenna transmission bandwidth to free users from procuring additional antennas is also is an issue to be addressed.

SUMMARY OF THE INVENTION

In view of the aforesaid problems occurring with the conventional techniques, the invention provides a broadband dipole array antenna that has a dipole array antenna and a reflection plate coupled in a normal manner to reflect the antenna radiation signals in a selected direction and enhance the directionality of the antenna. It also has a feed network containing a zigzag circuit to achieve a broad bandwidth.

In order to achieve the foregoing object, the broadband dipole array antenna according to the invention includes a feed network, radiation units and a reflection plate. The antenna is a printed circuit antenna with a first surface and a second surface. The feed network and the radiation units are located respectively on the first surface and the second surface to increase transmission bandwidth and generate radiation signals.

The reflection plate has a trough to hold the antenna vertically and reflect the radiation signals generated by the radiation units in a selected direction to enhance the directionality of the antenna.

The antenna and the reflection plate may be fastened with adhesive tape or a Velcro strip to facilitate assembly. Another fastening approach is to form apertures on the inner walls of the trough and the antenna on corresponding locations to be coupled by fastening elements.

The dipole antenna array thus constructed uses the reflection plate to enhance antenna directionality and boost directional gain. Fastening of the antenna and the reflection plate is more convenient. Hence the antenna directionality and convenience of antenna assembly are greatly improved.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
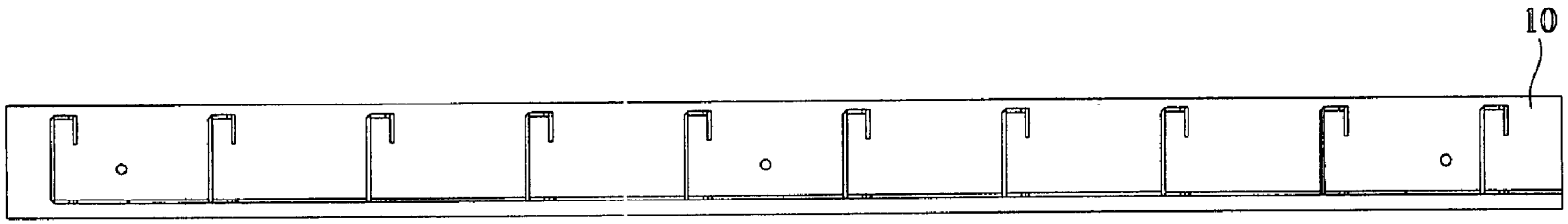
FIG. 1 (PRIOR ART)
FIG. 1 is a schematic view of the feed network of a conventional Series Feed antenna.
Figure 2:
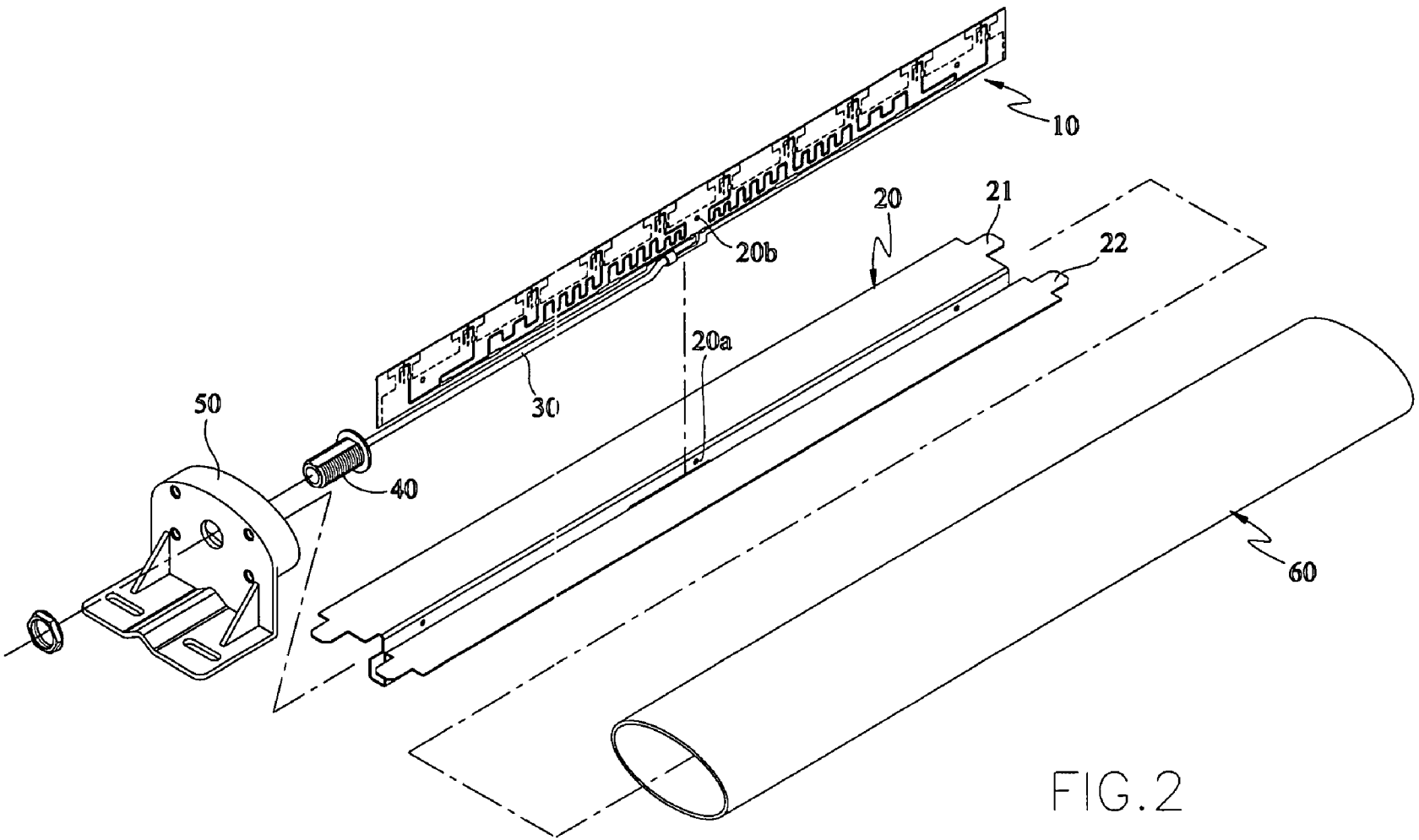
FIG. 2 is an exploded view of the antenna of the invention.

Referring to FIG. 2, the broadband dipole array antenna according to the invention includes an antenna 10, a reflection plate 20, a metal conductive wire 30, a connector 40, a seat 50 and a shell 60.

The antenna 10 is wedged vertically in a trough formed on the reflection plate 20. It is a printed circuit antenna made from non-metallic material (such as Rogers RO-4350B). It has a first surface 101 and a second surface 102 formed with a required circuit pattern by chemical etching.

The reflection plate 20 has lugs 21 and 22 extended from two ends to wedge in slots formed on the seat 50 and the shell 60 to anchor thereon. The reflection plate 20 is made of metal that has a shielding effect upon electromagnetic waves, and can therefore reflect radiation signals generated by the antenna 10 in a selected direction to boost the directional gain of the antenna.

The seat 50 is formed substantially in an L-shape to anchor on a bracing rack (not shown in the drawing) and house the connector 40. The connector 40 has one end connected to a signal feeding point 11 of the antenna 10 through the metal conductive wire 30, and another end connected to an electronic device (not shown in the drawing).

Figure 3:
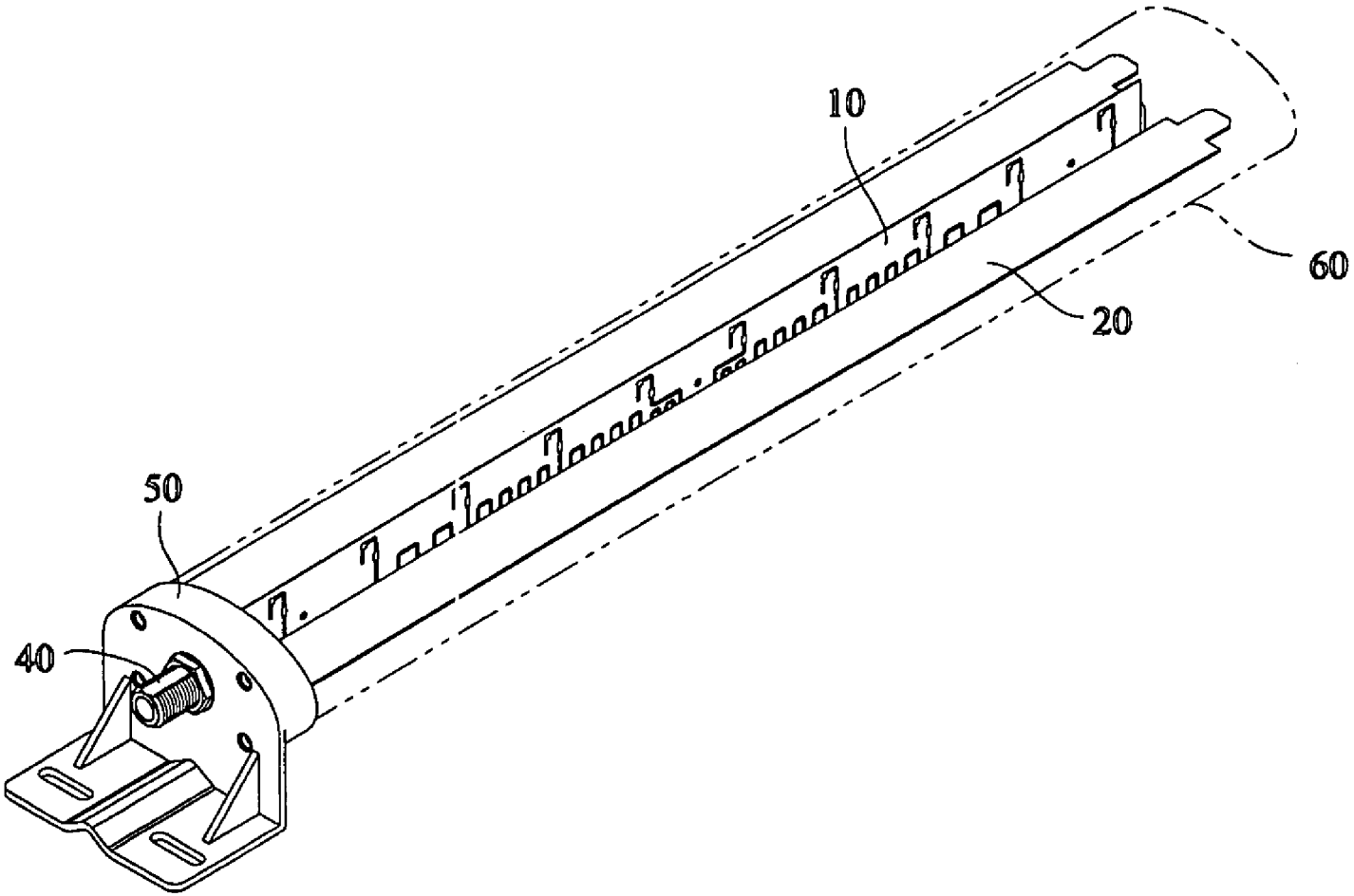
FIG. 3 is a perspective view of the antenna of the invention after assembly.

The shell 60 is coupled with the seat 50 to encase the antenna 10 and the reflection plate 20 to provide protection. Refer to FIG. 3, the shell 60 and the seat 50 form a sealed body to cover the antenna 10 and the reflection plate 20.

Figure 4A:
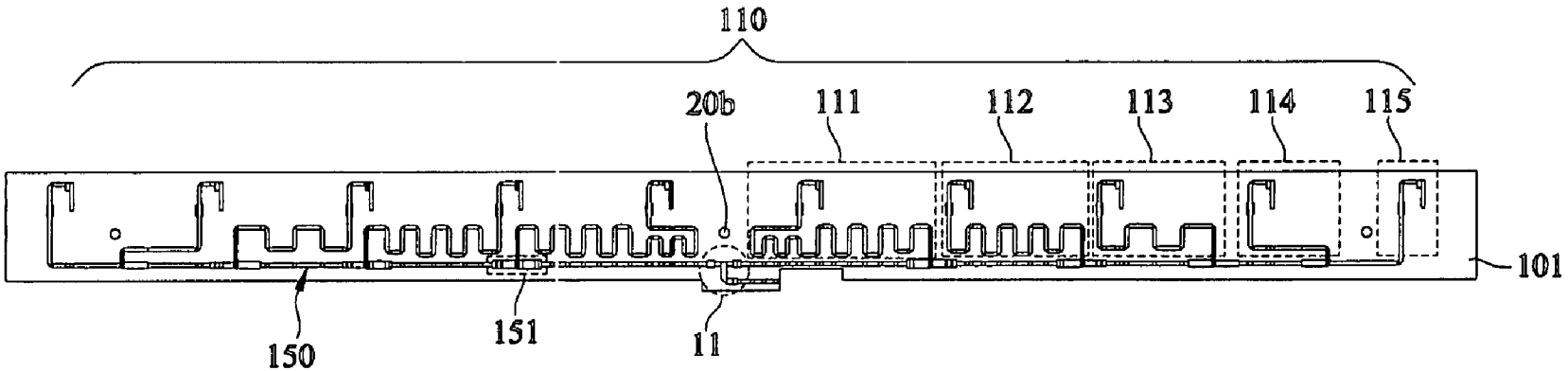
FIG. 4A is a plain view of a first surface of the antenna base-board of the invention.

Refer to FIG. 4A for the first surface of the antenna base-board. The first surface 101 has a feed network 110, which includes a signal feeding point 11 to serve as the center, a first feeding unit 111, a second feeding unit 112, a third feeding unit 113, a fourth feeding unit 114, and a fifth feeding unit 115, which are formed symmetrically on the left side and the right side to become the feed network 110. Each feeding unit has a different zigzag circuit, is extended towards two sides of the antenna 10 from the signal feeding point 11 in a zigzag manner with a decreasing zigzag path, and is connected to a transmission bus 150. The zigzag path forms the same phase from the signal feeding point 11 to each radiation unit 120 to increase transmission bandwidth. Moreover, each branch point is coupled with an impedance matching section 151 to match the required impedance of the circuit.

Figure 4B:
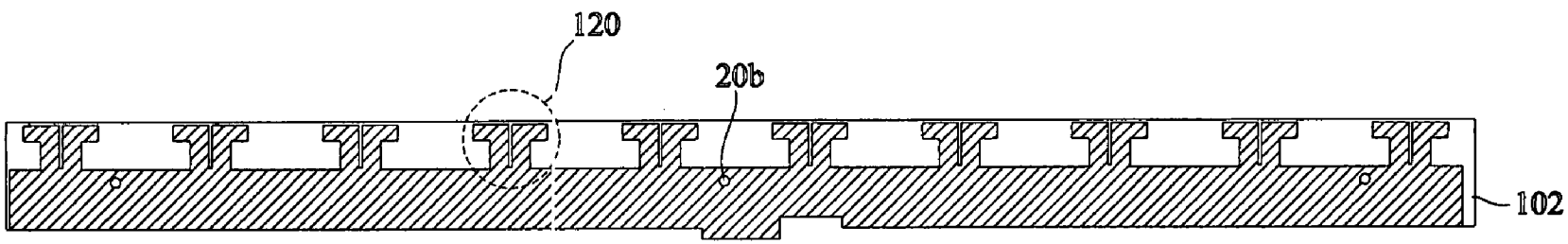
FIG. 4B is a plain view of a second surface of the antenna base-board of the invention.

Refer to FIG. 4B for the second surface of the antenna base-board. The radiation units 120 are located on the second surface 102 to couple with the signals of the feed network 110 and transmit them by radiation. Each radiation unit 120 is substantially formed in a T-shape. The signals radiated in the direction of the horizontal ends of the T-shaped structure are wider than those of the vertical end, thus having a more desirable directionality. When laying in a parallel manner directionality improves. Also, each radiation unit 120 corresponds to a feeding unit, and the radiation has a different signal gain depending on the corresponding feeding unit. This arrangement boosts the directional gain of the signals.

The reflection plate 20 has a trough to couple with the antenna 10 vertically and converge the electromagnetic wave radiated from the antenna 10 in a selected direction to enhance the directionality of the antenna 10. The reflection plate 20 is made of metal such as aluminum, iron or stainless steel. The depth of the trough affects the field shape direction range of the antenna 10. When the radiation unit 120 is located in the trough, the antenna 10 has a narrower field shape direction range. When the radiation unit 120 is located outside the trough, the antenna 10 has a wider field shape direction range.

The reflection plate 20 and the antenna 10 may be anchored on the lateral sides of the trough with adhesive tape or a Velcro strip to make assembly easier. Another approach is to form a plurality of first apertures 20*a* on the lateral sides of the trough of the reflection plate 20 and a plurality of second apertures 20*b* on the antenna 10 that correspond to each other and are coupled by fastening elements (such as plastic rivets, nails, plastic screws, and the like) to fasten and anchor the reflection plate 20 and the antenna 10.

In addition, the invention conforms to IEEE (Institute of Electrical and Electronic Engineers) 802.11a communication protocols. By fine-tuning the distance of the feed network 110 and the radiation units 120, and the elevation of the reflection plate 20, the invention may be used in the frequency spectrums ranging from 4.9 GHz to 5.875 GHz.

The dipole array antenna thus constructed can reflect and converge radiation signals to enhance the directionality of the antenna. By coupling the reflection plate and the antenna in a vertical manner, and anchoring both with adhesive tape or a Velcro strip, assembly is more convenient. Thus the antenna directionality and convenience of assembly are improved. Also, the zigzag circuit design of the feed network allows the broadband antenna to achieve an even wider transmission bandwidth.

Figure 5A:
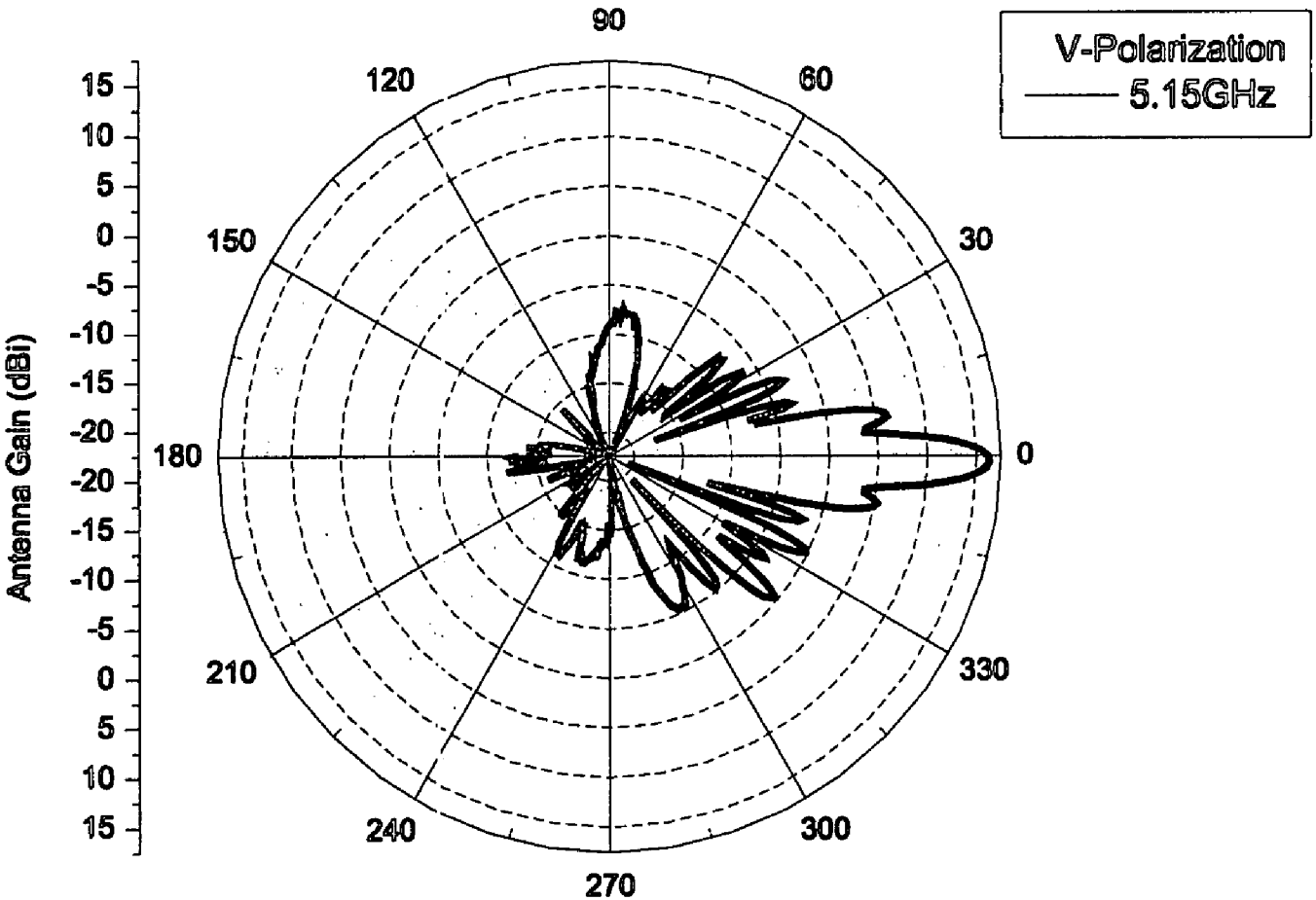
FIG. 5A~5C are a radiation field graphic of V-polarization according to the invention.
Figure 5B:
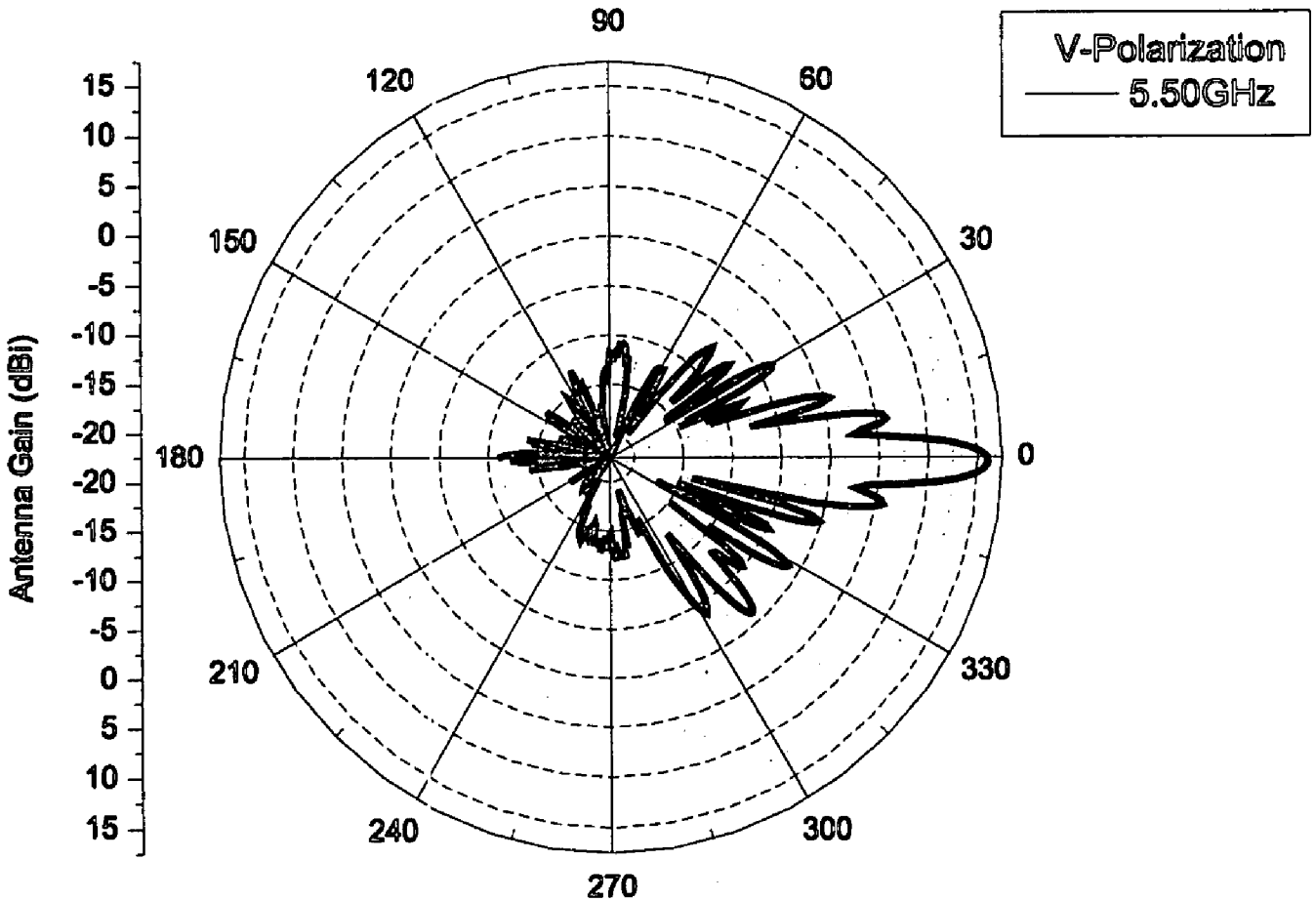
Figure 5C:
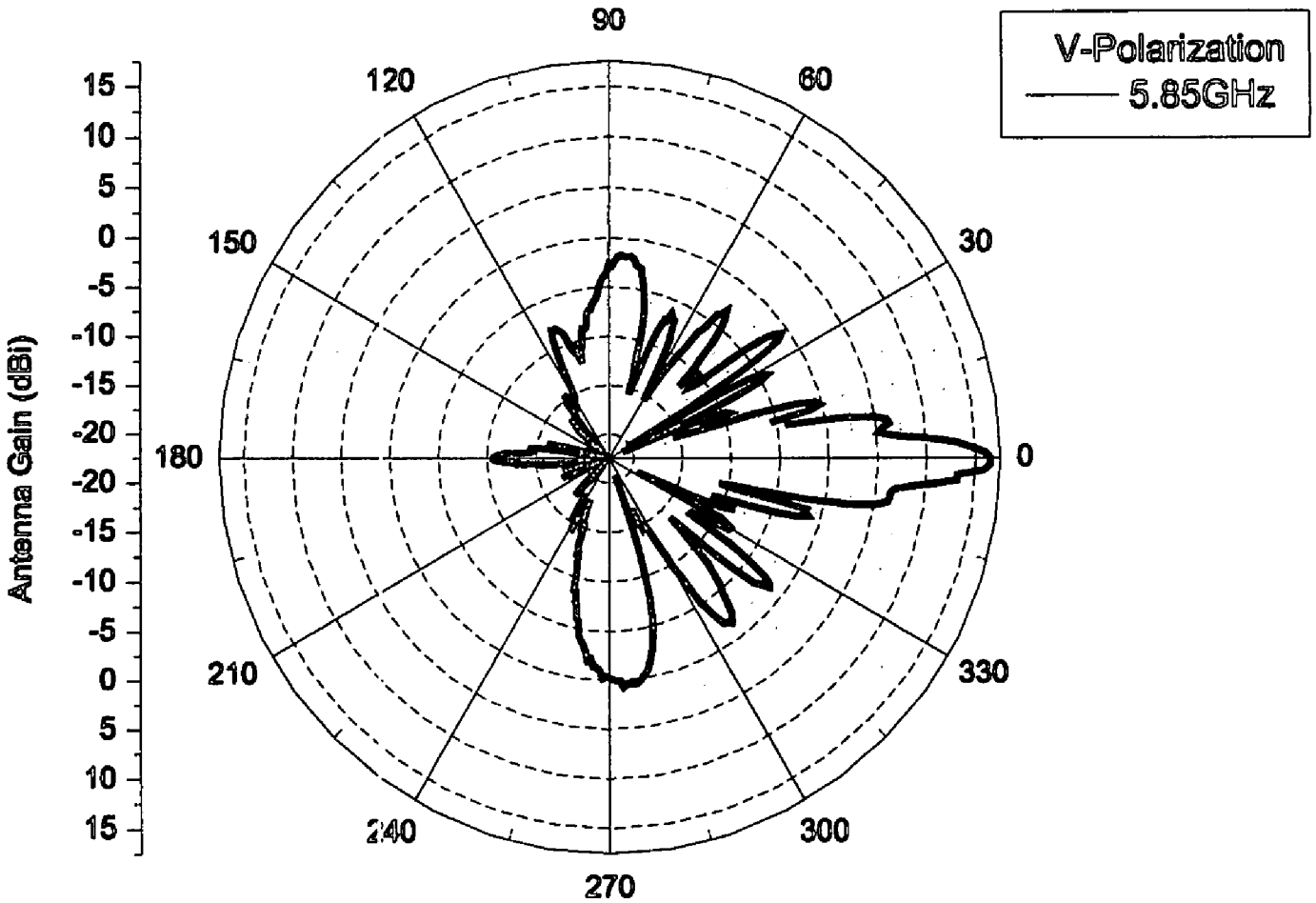
Figure 6A:
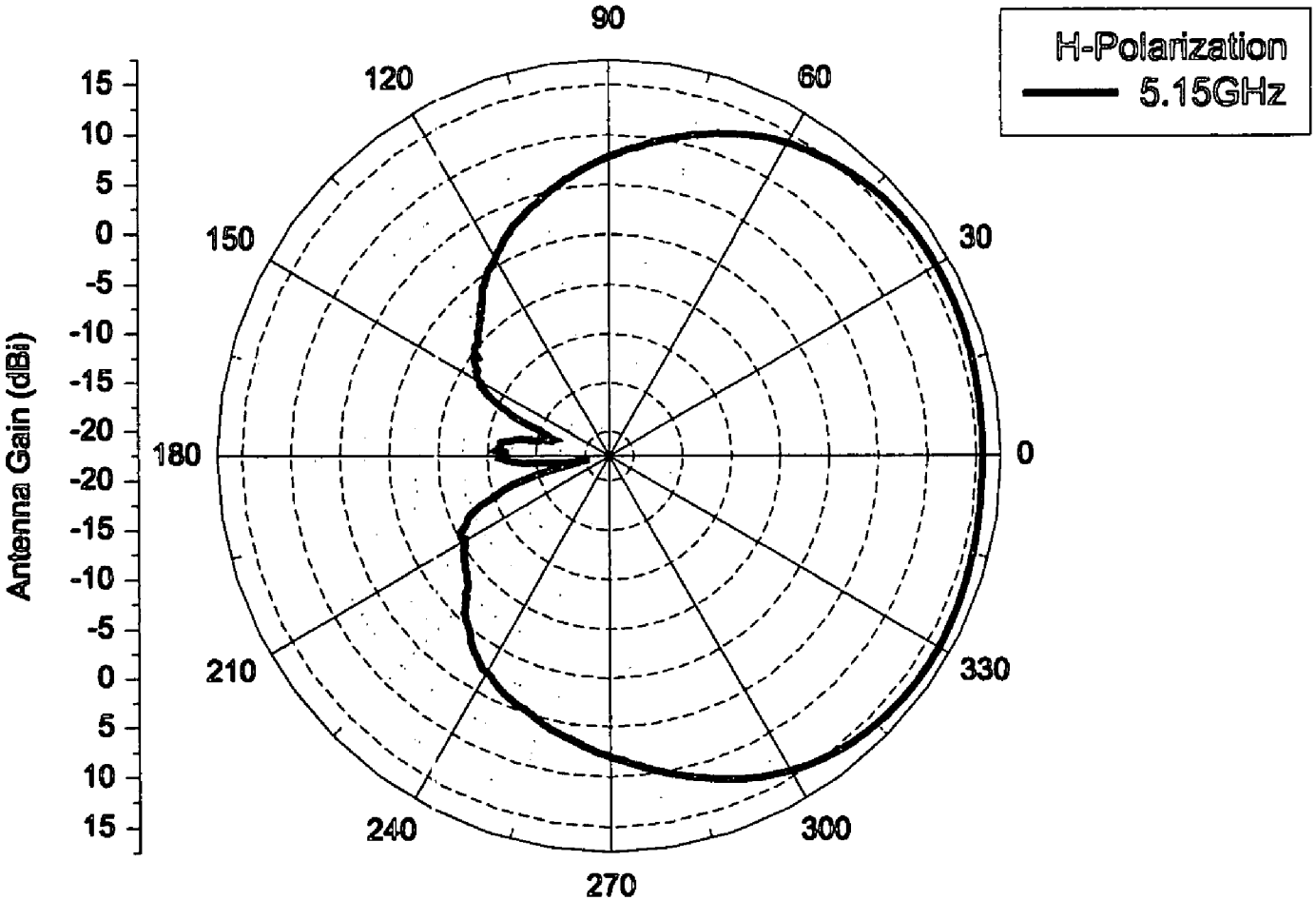
FIG. 6A~6C are a radiation field graphic of H-polarization according to the invention.
Figure 6B:
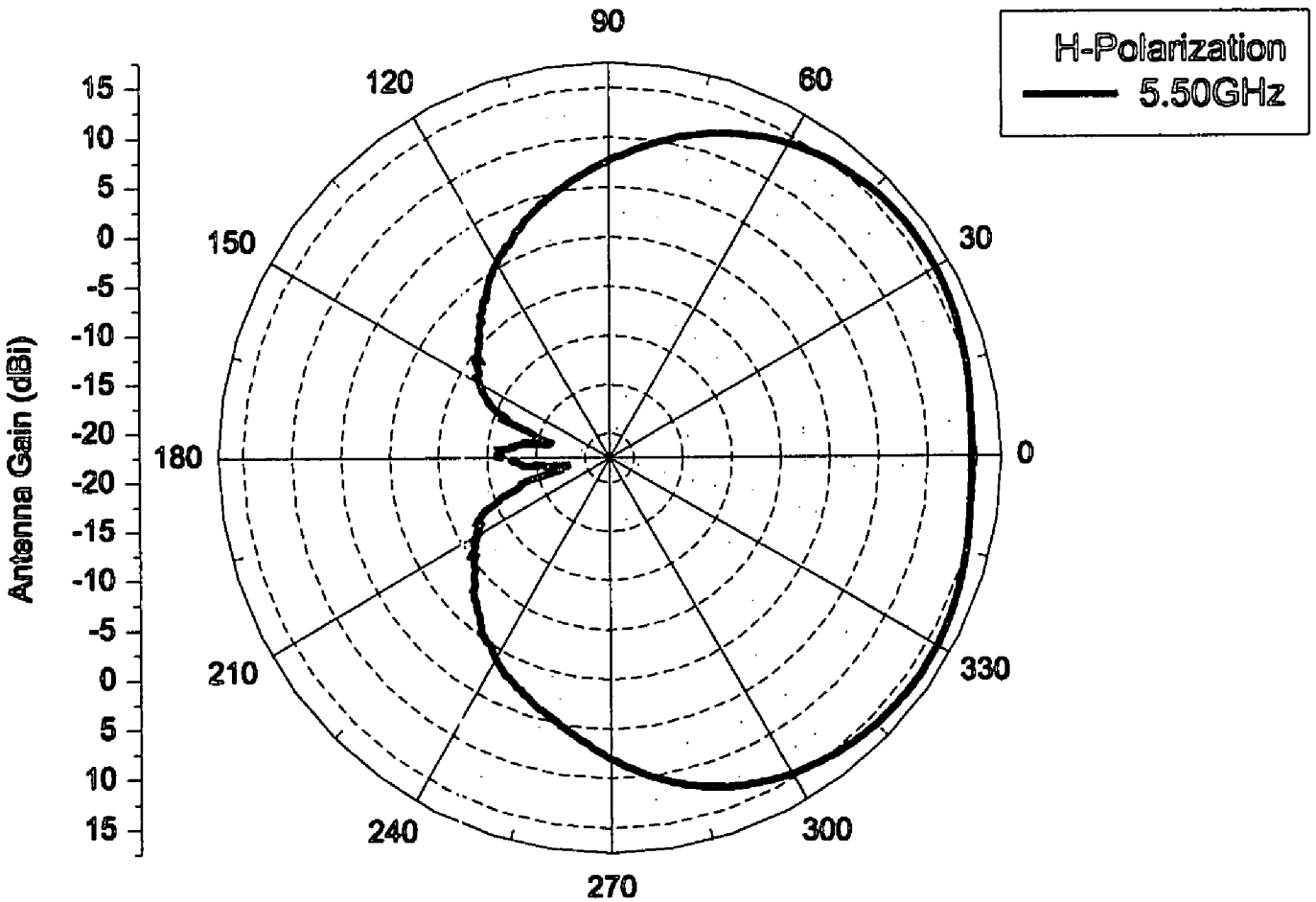
Figure 6C:
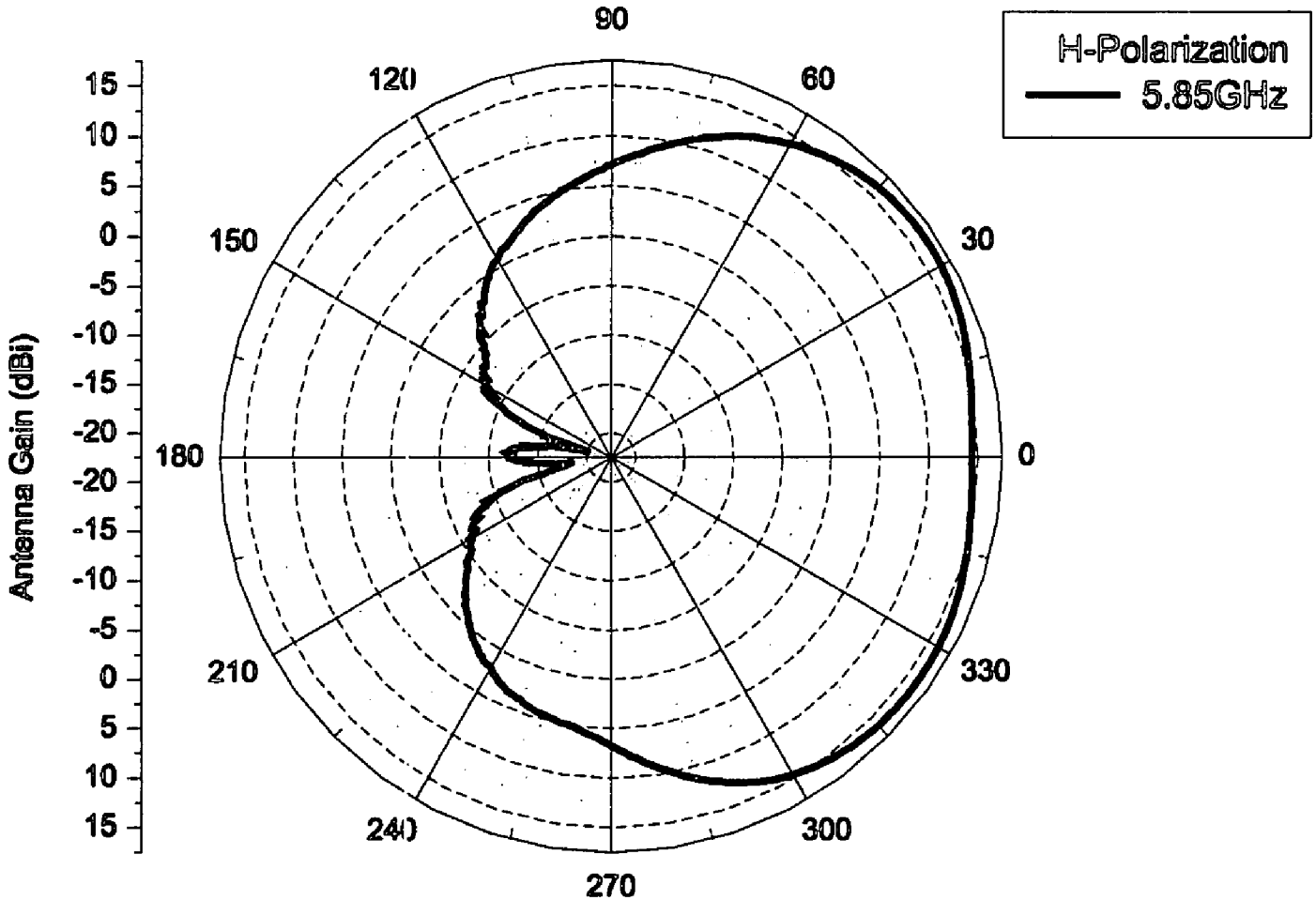
Figure 7:
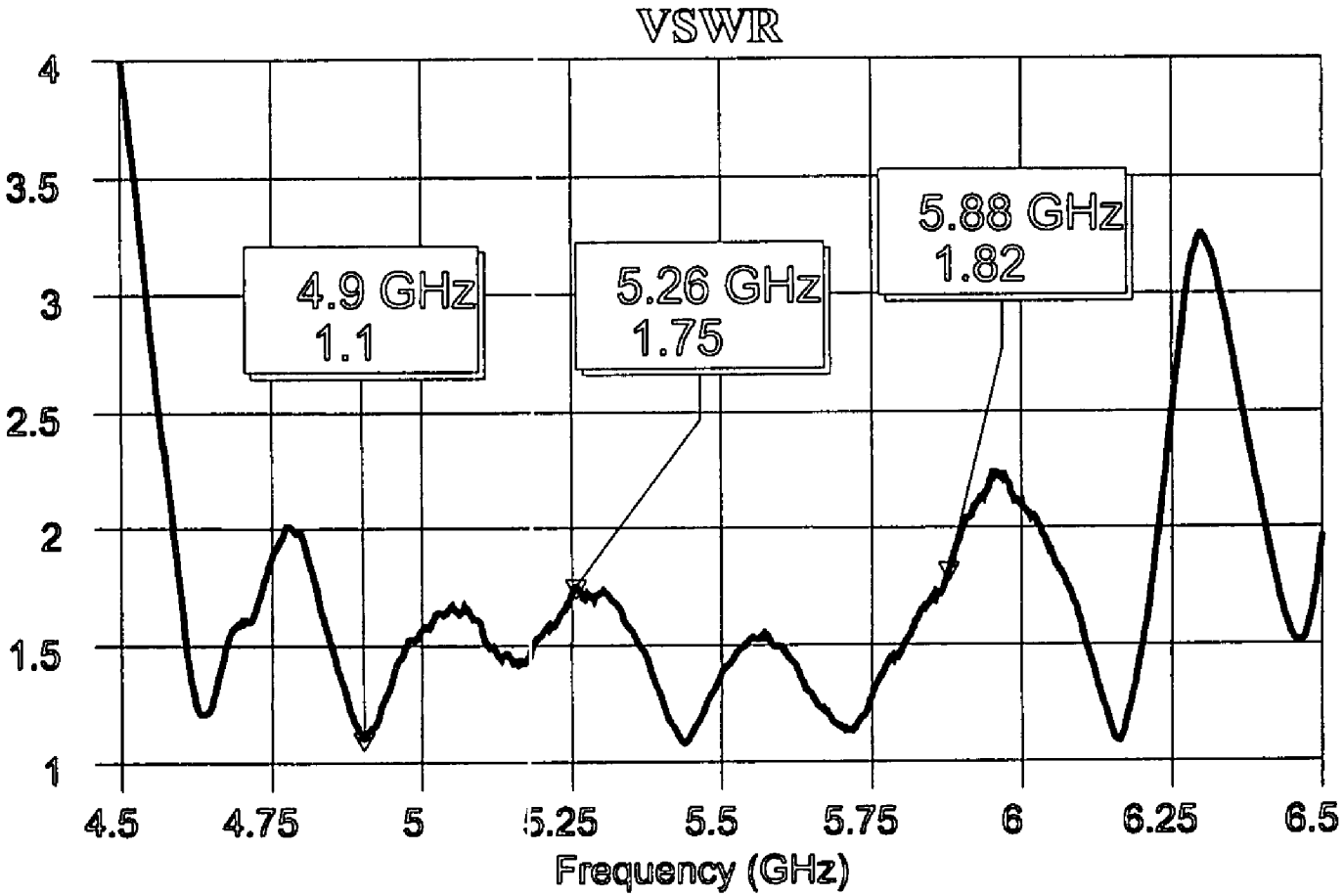
FIG. 7 is a chart of the voltage stationary wave ratios according to the invention.

Actual tests of the invention have been conducted based on frequencies 5.15 GHz, 5.50 GHz, and 5.85 GHz. The results are indicated in radiation field graphics and a voltage stationary wave ratio test chart as follows. FIG. 5A~5C are the radiation field graphic of V-polarization. FIG. 6A~6C are the radiation field graphic of H-polarization. FIG. 7 is the chart of the measured voltage stationary wave ratios with frequencies in the range of 4.50 GHz ~6.50 GHz.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A broadband dipole array antenna located on a base board which has a first surface and a second surface to radiate a radio signal, comprising:

a feed network located on the first surface consisting of a plurality of feeding units each containing a circuit laid in a zigzag fashion to increase the transmission bandwidth of the radio signal;

a plurality of radiation units located on the second surface to couple with the signal of the feeding units and to radiate the signal; and a reflection plate made of metal having a trough to hold the antenna vertically to reflect the radiation signal in a selected direction and enhance the directionality of the antenna.

2. The broadband dipole array antenna of claim 1, wherein the antenna is a printed circuit antenna.

3. The broadband dipole array antenna of claim 1, wherein the base board is made from Rogers RO-4350B.

4. The broadband dipole array antenna of claim 1, wherein the reflection plate is made of a material which includes aluminum.

5. The broadband dipole array antenna of claim 1, wherein the reflection plate is made of a material which includes iron.

6. The broadband dipole array antenna of claim 1, wherein the reflection plate is made of a material which includes stainless steel.

7. The broadband dipole array antenna of claim 1, wherein the trough has a plurality of apertures formed on side walls thereof to fasten the antenna to the reflection plate.

8. The broadband dipole array antenna of claim 1, wherein the reflection plate and the antenna are fastened through an adhesive tape.

9. The broadband dipole array antenna of claim 1, wherein the reflection plate and the antenna are fastened through a Velcro strip.

10. The broadband dipole array antenna of claim 1, wherein the antenna and the reflection plate are encased in a shell to be protected thereof.

11. The broadband dipole array antenna of claim 1, wherein the reflection plate has at least one lug on one end to wedge in a corresponding slot formed on a seat to anchor the reflection plate.

12. The broadband dipole array antenna of claim 1, wherein the radiation units are located in the trough.

13. The broadband dipole array antenna of claim 1, wherein the radiation units are located outside the trough.

* * * * *